United States Patent [19]

Hudson

[11] 4,184,732

[45] Jan. 22, 1980

[54] PLUG RETAINING DEVICE

[76] Inventor: Gerald E. Hudson, 229 15th St. West, Billings, Mont. 59102

[21] Appl. No.: 919,243

[22] Filed: Jun. 26, 1978

Related U.S. Application Data

[62] Division of Ser. No. 859,948, Dec. 12, 1977, Pat. No. 4,139,253, which is a division of Ser. No. 619,026, Oct. 2, 1975, abandoned.

[51] Int. Cl.[2] ..... H01R 13/54

[52] U.S. Cl. ..... 339/75 P

[58] Field of Search ..... 339/75 P, 39, 104, 106, 339/36

[56] References Cited

U.S. PATENT DOCUMENTS

| | | | |
|---|---|---|---|
| 1,989,823 | 2/1935 | Raabe | 339/75 P |
| 2,720,633 | 10/1955 | Westberg | 339/75 P |
| 2,721,313 | 10/1955 | English | 339/75 P |
| 3,327,280 | 6/1967 | Levine et al. | 339/36 |

*Primary Examiner*—E. F. Desmond

[57] ABSTRACT

A retaining device for preventing withdrawal of an electric plug from an extension cord socket responsive to forces exerted on a cord connected to the plug. The devices of the first and second embodiments are used with extension cord sockets. In the device of the first embodiment, a resilient C-shaped clamp abuts the opposite end walls of the plug and socket. The ends of the clamp are releasably connected to each other by a flexible chain which positively maintains the plug electrically connected to the socket. In the device of the second embodiment, a pair of retaining straps are secured to one of the connectors, and a pair of ears are secured to the other connector. The ears, engaged by the retaining straps, prevent withdrawal of the plug from the socket. An adaptor shell is provided to allow use of the device of the second embodiment with plugs substantially smaller in width than the socket.

2 Claims, 4 Drawing Figures

PLUG RETAINING DEVICE

This is a divison of application Ser. No. 859,948, filed Dec. 12, 1977, now U.S. Pat. No. 4,139,253, issued Feb. 13, 1979, which is a division of Ser. No. 619,026, filed Oct. 2, 1975, now abandoned.

BACKGROUND OF THE INVENTION

1. Field of the Invention

This invention relates to devices for securing electrical connectors to each other and, more particularly, to devices for preventing disconnection of a plug from conventional wall or extension cord sockets.

2. Description of the Prior Art

Electrical devices are commonly powered through a supply cord terminating in an electrical plug having exposed parallel prongs adapted to be inserted into the recesses of a supply socket. Since many of these electrical devices are somewhat portable, forces are often exerted on the electrical supply cord which may disengage the plug from the socket, strain the prongs of the plug, or damage the cord at the point where the cord meets the plug.

Many attempts have been made in the prior art to overcome the above-described problems. U.S. Pat. No. 2,913,719, issued to Martin, discloses a plug coupling in which a tapered liner member surrounds the cord adjacent the plug, and a tapered shell connected to the outlet is slipped over the liner. Forces exerted on the supply cord cause the shell to compress the liner to prevent relative movement between the cord and shell.

U.S. Pat. Nos. 2,461,427 and 2,720,633, issued to Kneebone and Westberg, respectively, disclose devices for maintaining an electrical connection between a plug and an extension cord socket. However, the device of Kneebone does not prevent damage to the plug prongs; and the device of Westberg does not adequately prevent plug and cord separation since the clamp is resilient, which allows the connectors to be separated by a sufficient force.

SUMMARY OF THE INVENTION

It is an object of this invention to provide a plug retaining device which may be used with a wide variety of plugs and sockets.

It is another object to provide a plug retainer which prevents plug withdrawal even when the supply cord is subjected to stresses of substantial magnitude.

It is still another object to provide a plug retaining device which is compact and easy to use.

These and other objects of the invention are accomplished by a retaining device in which the supply cord or a plug is clamped to an extension socket. Since the device positively, and not resiliently, joins the two connectors, the retaining device is able to withstand greater forces than prior art devices.

DETAILED DESCRIPTION OF THE INVENTION

Figure 1:
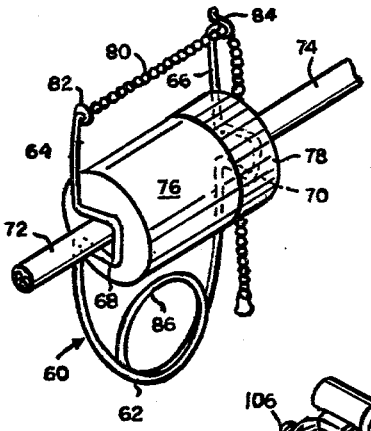
FIG. 1 is an isometric view of the retaining device of the first embodiment used to secure a plug to an extension cord socket.

A first embodiment of the retaining device used for securing a plug to the socket of an extension cord is illustrated in FIG. 1. The device includes a spring metal clamp 60, preferably coated with an insulator, such as plastic, which is formed into a C shape having a curved portion 62 and substantially straight legs 64, 66. Loops 68, 70 are formed in respective legs 64, 66 which partially surround the extension cord 72 and the supply cord 74 connected, respectively, to a socket 76 and plug 78. The ends of the legs 64, 66 are forced together until the loops 68, 70 abut opposed surfaces of the socket 76 and plug 78. The ends are maintained in this position by a chain 80 which is permanently secured to a loop 82 formed at the end of one leg 64 and releasably secured to a second loop 84 formed at the end of the other leg 66. A coil 86 is formed in the clamp 60 at the curved area 62 to increase the resiliency of the clamp 60 so that the retaining device can accommodate sockets and plugs of greatly varying lengths.

In operation, the plug 78 is connected to the socket 76, and the legs 64, 66 are placed on either side of the connectors 76, 78, with the chain 80 disengaged from the loop 84. The ends of the legs 64, 66 are manually drawn toward each other so that the loops 68, 70 abut, respectively, the socket 76 and plug 78, and the chain 80 is then inserted into the loop 84 to maintain the ends of the legs 64, 66 spaced apart by a fixed distance. The chain 80 provides a positive lock between the socket 76 and plug 78 to withstand unusually strong forces between the cords 72, 74.

Figure 2:
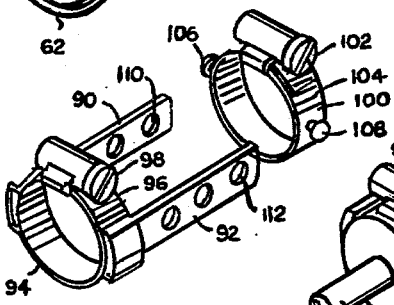
FIG. 2 is an isometric view of the retaining device of the second embodiment.
Figure 3:
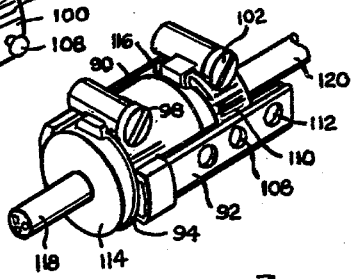
FIG. 3 is an isometric view of the retaining device of FIG. 2 illustrated in use for securing a plug to the socket of an extension cord.

A second embodiment of the retaining device is illustrated in FIGS. 2 and 3. The second embodiment includes a pair of retaining straps 90, 92 secured to opposite sides of a band 94. The band 94 has formed therein a series of substantially transverse slots 96 which are engaged by threads on a screw 98. The screw 98 is rotatably fastened to one end of the band 94 such that rotation of the screw 98 varies the diameter of the circle formed by the band. Another band 100 also includes a screw 102 rotatably fastened to one end of the band 100. The threads of the screw engage the slots 104 formed in the band 100. A pair of ears 106, 108 are secured to the outside surface of the band 100 in opposite positions to correspond to the location of the retaining straps 90, 92. The retaining straps 90, 92 contain a series of equally spaced apertures 110, 112 which may engage respective ears 106, 108. The device of the fourth embodiment is shown in FIG. 9 as used to join a pair of connectors 114, 116 connected to respective cords 118, 120. Initially, the band 94 is placed loosely around the connector 114. The screw 98 is then rotated to reduce the diameter of the band 94 to frictionally hold the band 94 in place on the connector 114. Similarly, the band 100 is placed loosely around the connector 116 and, while the connectors 114, 116 are mating with each other, the ears 106, 108 are inserted through respective apertures 110, 112. This insures proper alignment of the ears 106, 108 with the apertures 100, 112 on the retaining straps 90, 92. The screw 102 is finally rotated so that the band 100 frictionally engages the connector 116. To disconnect the connectors 114, 116 from each other, the retaining straps 90, 92 are forced outwardly to remove the ears 106, 108 from the apertures 110, 112, thereby allowing relative axial movement between the connectors 114, 116.

Figure 4:
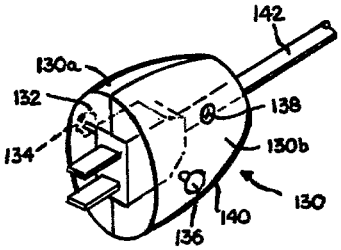
FIG. 4 is an isometric view illustrating an adaptor shell allowing the retaining device of the second embodiment to be used with plugs which are substantially smaller than the socket.

The connectors 114, 116, as illustrated in FIG. 3, are of equal width. However, when the connectors are of differing width, an adaptor must be used to place the ears apart from each other by the distance between retaining straps. For this purpose, an adaptor shell 110, as shown in FIG. 4, encloses the smaller of the two connectors, shown here as a plug 132. The adaptor shell is divided into two halves 130*a*, 130*b*, each containing an ear 134, 136. The two halves 130*a*, 130*b* are connected to each other by threaded fasteners 138, 140, such as screws or bolts, which straddle the cord 142 connected to the plug 132. The inside of the shell 130 corresponds to the shape of the plug 132 so that the plug 132 is held securely in place. The width of the shell 130 between the ears 134, 136 is approximately equal to the width of the connector with which the plug 132 mates. Although the shell 130 is shown here as supporting a pair of ears 134, 136, it is to be understood that the shell 130 may instead support a pair of retaining straps. Under these circumstances, the connector with which the plug 132 mates would include a pair of ears corresponding to the retaining straps. Similarly, the connector within the shell may be a socket instead of the plug 132 shown in FIG. 4. The connector having the smallest width will always be the connector placed inside the shell 130.

The embodiments of the invention in which a particular property or privilege is claimed are defined as follows:

1. In a C-shaped, spring metal clamp for preventing disconnection of a plug from the socket of an extension cord, the legs of said clamp surrounding cords connected to said plug and socket and abutting the ends of said plug and socket, the improvement comprising releasable connecting means including a length of chain permanently secured to the end of one clamp leg and releasably secured to the end of the other clamp leg, and said releasable connecting means fastened between said legs adjacent the ends thereof for maintaining the distance between said legs substantially constant responsive to opposed forces exerted, respectively, on said plug and socket.

2. The clamp of claim 1 wherein a coil is formed in said clamp intermediate said plug and socket to increase the resiliency of said clamp to accommodate plugs and sockets of greatly varying lengths.

* * * * *